US007591884B2

(12) United States Patent
Lee et al.

(10) Patent No.: US 7,591,884 B2
(45) Date of Patent: Sep. 22, 2009

(54) AIR CLEANER WITH ELECTROSTATIC FLOCKED PILES

(75) Inventors: Sung-Hwa Lee, Gyeongsangnam-Do (KR); Sung-Hwan Lee, Gyeongsangnam-Do (KR); Ok-Chun Hyun, Basan (KR)

(73) Assignee: LG Electronics Inc., Seoul (KR)

( * ) Notice: Subject to any disclaimer, the term of this patent is extended or adjusted under 35 U.S.C. 154(b) by 411 days.

(21) Appl. No.: 11/586,609

(22) Filed: Oct. 26, 2006

(65) Prior Publication Data

US 2007/0095211 A1 May 3, 2007

(30) Foreign Application Priority Data

Nov. 2, 2005 (KR) ..... 10-2005-0104592

(51) Int. Cl.
*B03C 3/011* (2006.01)
*B03C 3/47* (2006.01)

(52) U.S. Cl. ..... 96/58; 96/69; 96/77; 96/98

(58) Field of Classification Search ..... 96/55, 96/57, 58, 69, 77–79, 96, 98, 99
See application file for complete search history.

(56) References Cited

U.S. PATENT DOCUMENTS

| | | | | | |
|---|---|---|---|---|---|
| 895,729 | A * | 8/1908 | Cottrell | ..... | 95/73 |
| 1,428,839 | A * | 8/1922 | Fortescue | ..... | 96/62 |
| 2,593,869 | A * | 4/1952 | Fruth | ..... | 96/16 |
| 5,290,343 | A * | 3/1994 | Morita et al. | ..... | 96/39 |
| 5,403,383 | A * | 4/1995 | Jaisinghani | ..... | 95/69 |
| 5,466,279 | A * | 11/1995 | Hattori et al. | ..... | 96/69 |
| 5,792,243 | A * | 8/1998 | Meffert et al. | ..... | 96/83 |
| 6,251,171 | B1 * | 6/2001 | Marra et al. | ..... | 96/69 |
| 6,398,852 | B1 * | 6/2002 | Loreth | ..... | 96/63 |
| 6,428,610 | B1 * | 8/2002 | Tsai et al. | ..... | 96/15 |
| 6,497,754 | B2 * | 12/2002 | Joannou | ..... | 96/67 |
| 6,966,939 | B2 * | 11/2005 | Rammig et al. | ..... | 55/486 |
| 2004/0211160 | A1 * | 10/2004 | Rammig et al. | ..... | 55/382 |
| 2008/0034973 | A1 * | 2/2008 | Griffiths et al. | ..... | 96/58 |

FOREIGN PATENT DOCUMENTS

| | | | | | |
|---|---|---|---|---|---|
| GB | 2090547 | A * | 7/1982 | ..... | 96/96 |
| JP | 4-135661 | A * | 5/1992 | ..... | 96/96 |
| WO | WO 90/07382 | A1 * | 7/1990 | ..... | 96/98 |

* cited by examiner

*Primary Examiner*—Richard L Chiesa
(74) *Attorney, Agent, or Firm*—KED & Associates, LLP

(57) ABSTRACT

An air cleaner including an ionization unit and a dust collection unit is provided. A plurality of electrostatic flocked piles may be provided on the ionization unit, or on the dust collection unit, or on both the ionization unit and the dust collection unit. The electrostatic flocked piles further improve air cleaning performance by filtering out foreign materials through both physical contact and by filtering ionized foreign materials using electrostatic attraction. The air cleaner may be widely adapted for use with various types of air conditioning apparatuses, as well as in a stand alone application.

18 Claims, 5 Drawing Sheets

AIR CLEANER WITH ELECTROSTATIC FLOCKED PILES

BACKGROUND OF THE INVENTION

1. Field of the Invention

The present invention relates to an air cleaner, and more particularly, to an air cleaner which further improves air cleaning performance through physical filtering and through filtering using an electrostatic force.

2. Background of the Related Art

An air cleaner is a device that operates to remove particulates such as fine dust, fine contaminants, etc., or remove bad odors or the like.

Air cleaners can be divided into electric filtration types, electric dust collection types, anion generation types, mechanical filter types and others, according to a particulate removal mechanism. Air cleaners can also be classified as ozone generation types and carbon adsorption types based on odor removal mechanism.

While the electric filtration type and the electric dust collection type have high initial contaminant removal performance, in particular, a high CADR (clean air delivery rate), they have a disadvantage in that their performance is drastically reduced after a sustained period of continuous use. The filters in such devices have to be frequently replaced. The anion generation generally has low maintenance costs, but its filter performance is poor. The mechanical filter type is high in clean air delivery rate, the life span of a filter is long, and its maintenance cost is low, but the filter size is large, which leads to a disadvantage that the volume of the entire system is large and it is difficult to make it compatible with other systems.

FIG. 1 schematically illustrates an air cleaner according to a conventional electric dust collection mechanism. An ionization unit 1 uses a high voltage discharge to ionize foreign materials such as dust and the like in the air passing through the ionization unit. The ionized foreign materials are then collected in a dust collection unit 2 by an electrostatic force. The dust collection unit 2 comprises a pair of cathode plates 4*a* and a dust collecting electrode plate 4*b* made of a cathode. The ionization unit 1 comprises a discharge line 3*a* composed of a thin wire made of, for example, tungsten and forming an anode. A pair of opposed discharge electrode plates 3*b* are mounted at upper and lower sides at a predetermined height gap from the discharge line 3*a* and form a cathode. When a high voltage is applied to the discharge line 3*a*, current starts to flow due to a high potential difference formed between the discharge line 3*a* and the opposed discharge electrode plate 3*b* and a corona discharge takes place. This discharge ionizes dust in the air flowing in the direction indicated by the arrows. Typically, a plurality of discharge lines 3*a* and opposed discharge electrode plates 3*b* are formed side by side at regular intervals.

SUMMARY OF THE INVENTION

An object of the invention is to solve at least the above problems and/or disadvantages and to provide at least the advantages described hereinafter.

An object of the present invention is to provide a novel air cleaning mechanism which can improve air cleaning capability in an air cleaner.

Another object of the present invention is to provide a dust collection system which increases the collection area or collectability of foreign materials in an air cleaner.

Yet another object of the present invention is to provide an air cleaner which is easy to apply to an air conditioning apparatus or the like.

An electrostatic air cleaner embodying the invention includes an ionization unit configured to impart an electrical charge to particles contained in a flow of air entering the air cleaner, and a collection unit configured to remove and collect particles from the flow of air entering the air cleaner, wherein a plurality of flocked piles are disposed on at least one of the ionization unit and the collection unit. The plurality of flocked piles could be disposed on electrodes of the ionization unit, and/or on collection plates of the collection unit. In some embodiments of the invention, a voltage may be applied to the flocked piles on the collection plates of the collection unit. The voltage would serve to electrically polarize the plurality of flocked piles such that the plurality of flocked piles electrically attract particles in the air flowing through collection unit.

In some embodiments of the invention, the electrodes and collection plate could be plate shaped, and in other embodiments, they may be formed of a metal mesh. Some embodiments of the invention may include an auxiliary filter in addition to the collection unit. The auxiliary filter could be disposed between the ionization unit and the collection unit, and a plurality of flocked piles may also be disposed on the auxiliary filter.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements, and wherein.

DETAILED DESCRIPTION OF PREFERRED EMBODIMENTS

An air cleaner embodying the invention includes an ionization unit which causes a high voltage discharge; and a dust collection unit for collecting foreign materials that have been ionized while passing through the ionization unit. A plurality of electrostatic flocked piles are disposed on either the ionization unit or the dust collection unit, or both. The electrostatic flocked piles perform a dual filtering action by filtering out dust or foreign materials in the air at the ionization unit or the dust collection unit by physical contact, and by an electrostatic force, thereby doubling air cleaning performance. An air cleaner according to the present invention may further comprise an auxiliary filter in addition to the ionization unit and the dust collection unit. It is preferable that this auxiliary filter is formed between the ionization unit and the dust collection unit. However, the auxiliary filter may be mounted next to the dust collection unit to serve as a secondary dust collection unit. Preferably, the electrostatic flocked piles according to the present invention are also disposed on this auxiliary filter.

Flocking, or electrostatic flocking, is a finishing technique in which monofilaments, also called flocks or piles, are adhered onto the surface of various types of materials to give a velvet-like appearance. The flocks or piles are obtained by chopping cotton, synthetic fibers, etc. to a length of several mm. In the electrostatic flocking method, an adhesive is coated onto the surface of a material, and then flocks/piles are dispersed onto or adhered onto the surface of the material by using an electrostatic attraction force. Materials for electrostatic flocking are diverse, including wood, paper, textiles, plastics, glass, metal, etc. The piles to be flocked in an air filter embodying the invention include polymer materials such as nylon, rayon, polyester, etc. However, a variety of other fibrous materials can also be utilized.

An air filter embodying the present invention includes electrostatic flocked piles or fibrous layers in an ionization unit, and/or in the dust collection unit, and/or in an auxiliary filter. The electrostatic flocking is applied to the parts of the air filter in a manner that is similar to how flocking is conventionally applied to the surface of fabrics, or similar to a color printing technique. The electrostatic flocking further reinforces the filtering function through these piles or fibrous layers.

Figure 1:
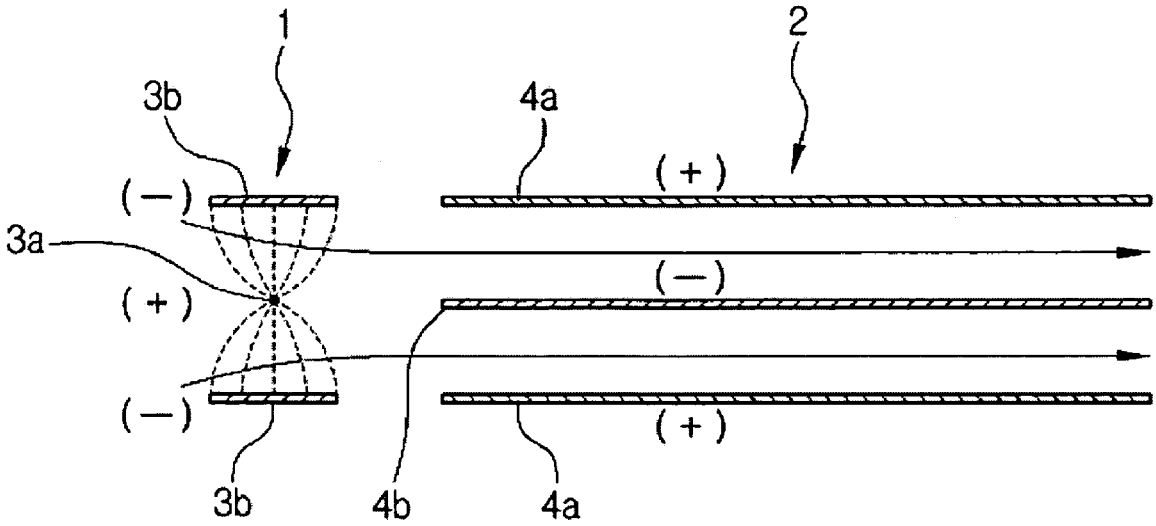
FIG. 1 RELATED ART
FIG. 1 is a schematic view illustrating an air cleaning mechanism of a conventional air cleaner.
Figure 2:
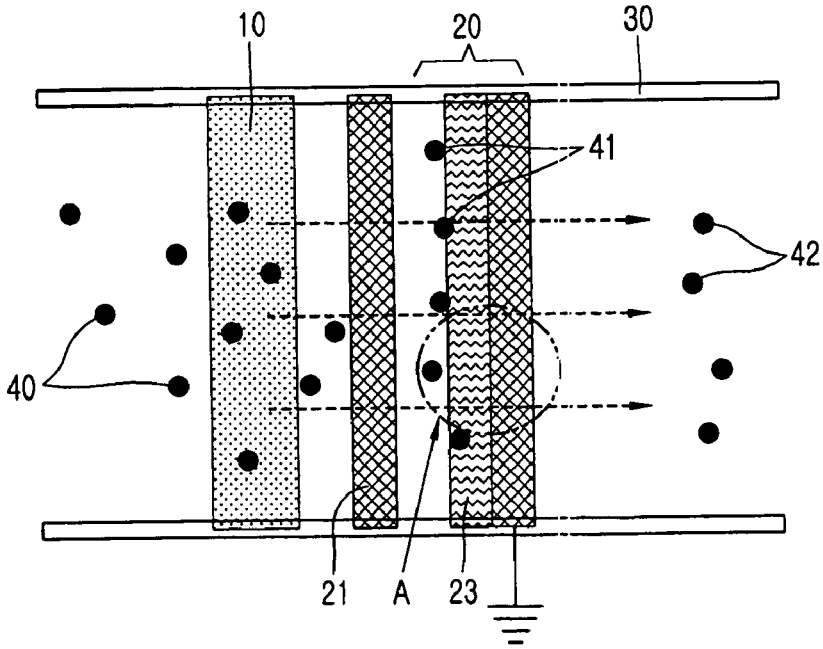
FIG. 2 is a schematic view illustrating an air cleaning mechanism of an air cleaner according to the present invention.

FIG. 2 schematically illustrates parts of an air cleaner according to one embodiment of the present invention. An ionization unit 10 is located at the front part of the air cleaner and ionizes foreign materials 40 such as dust or the like in the air flowing into the air cleaner. The structure of the ionization unit may be similar to that shown in FIG. 1. However, other arrangements could also be used and there are no special restrictions on its shape or size. To enlarge the ionization area, one electrode may be formed in a wire shape and the other electrode may be formed as a plate or mesh. Alternatively, both of the electrodes may be formed in a wire shape. A high voltage from a power supply unit 30 is applied to the ionization unit 10. Electrostatic flocked piles may also be disposed on the electrodes of the ionization unit. In this case, the flocked piles may provide their filtering action during the process of ionizing the foreign materials.

In addition, an auxiliary filter 21 may be mounted next to the ionization unit. The auxiliary filter may include a mesh-shaped electrode which preferably has electrostatic flocked piles bonded to its surface. An auxiliary filter having electrostatic flocked piles bonded thereto is able to electrostatically filter out dust using the electrostatic flocked piles. A high voltage would be applied to the flocked piles on the auxiliary filter, which would cause ionized particles in the air flow to be attracted to the flocked piles.

The dust collection unit 20 includes at least one electrode 22, and the electrode 22 preferably has electrostatic flocked piles 23 bonded thereto. When a high voltage is applied to the dust collection unit 20, dust 41 or the like ionized while passing through the ionization unit 10 is attracted to the electrostatic flocked piles 23 by an electrostatic force. The electrostatic flocked piles 23 increase the filtering effect by physically adsorbing the foreign materials 40, as well as by adsorbing the foreign materials by an electrostatic force.

The electrode 22 of the dust collection unit is preferably a mesh shaped electrode. The mesh-shaped electrode makes it easier to form electrostatic flocked piles on the electrode, and it allows the flow of air from which dust or the like has been removed to easily pass through the filter.

Figure 3:
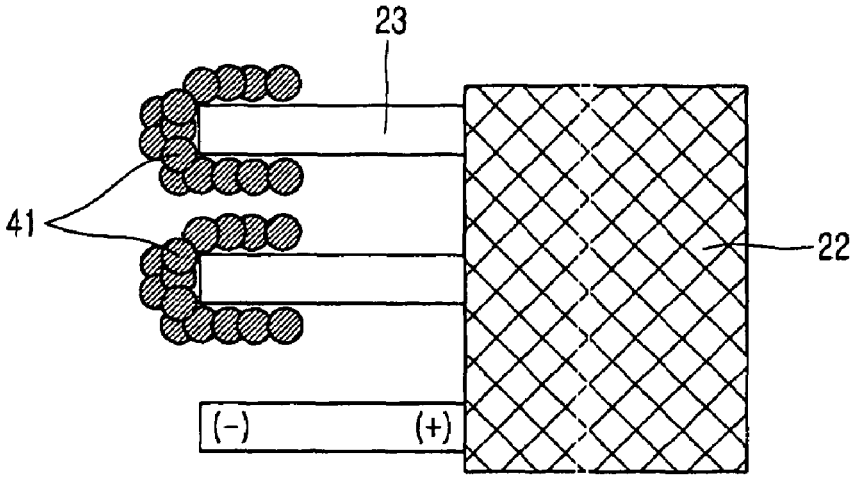
FIG. 3 is an enlarged view of part A of FIG. 2.

FIG. 3 is an enlarged view of part 'A' of FIG. 2, which schematically illustrates the electrostatic flocked piles 23 which are bonded onto the surface of the mesh electrode 22. The dust particles 41 are adsorbed to the electrostatic flocked piles 23. Such dust filtering is caused by the polarization orientation property of the electrostatic flocked piles. The polarization orientation of the electrostatic flocked piles is described below with reference to FIG. 4.

Figure 4:
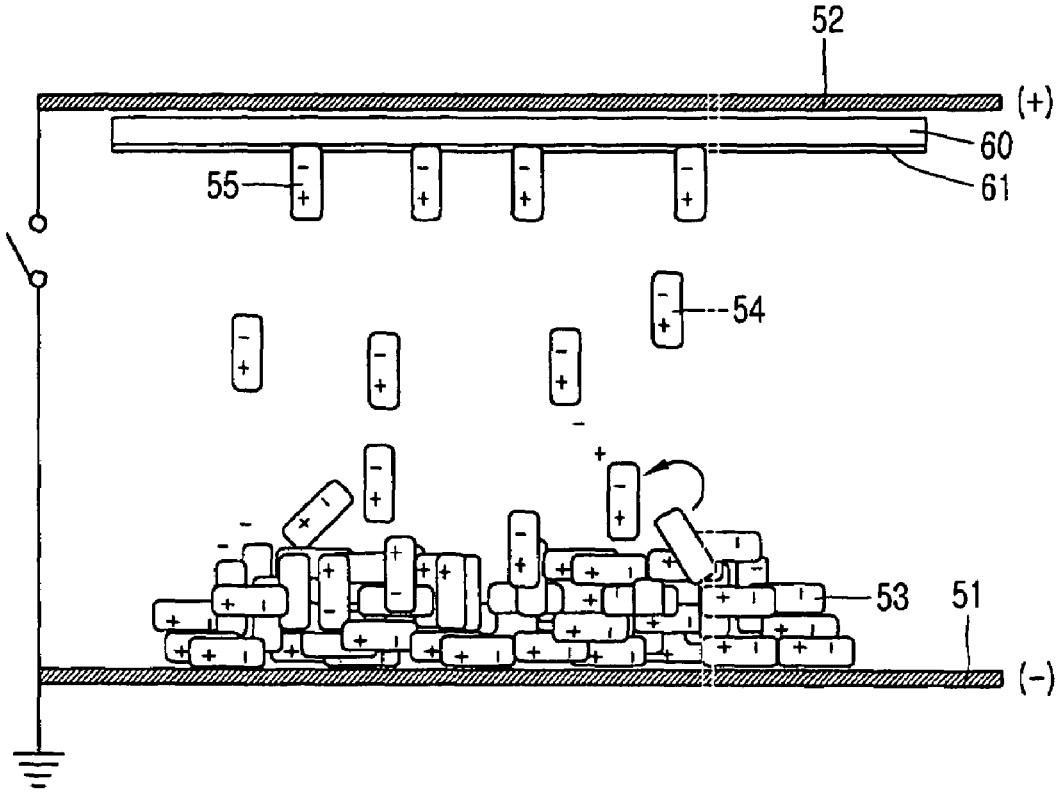
FIG. 4 is a schematic view illustrating an electrostatic flocking process.

FIG. 4 schematically illustrates an electrostatic flocking process. Piles 53 to be flocked are disposed between two electrodes 51 and 52. The polarization orientation of the piles occurs when a voltage is applied to the electrodes, and the polarized piles 54 move towards a substrate 60. An adhesive layer 61 is formed in advance on the surface of the substrate 60 and the piles 55 are secured to the substrate 60 by the adhesive 61.

Figure 5:
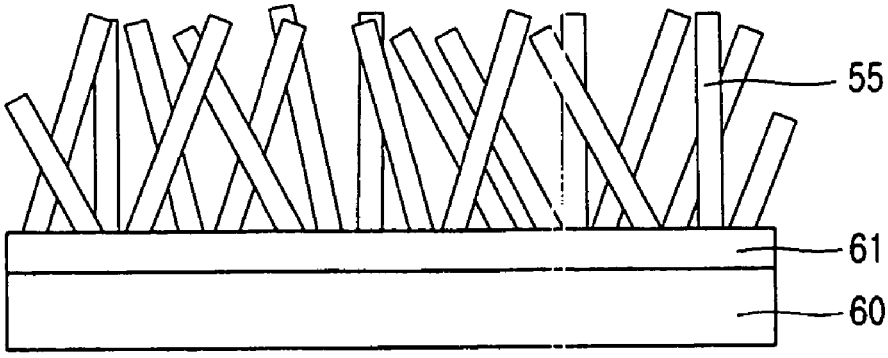
FIG. 5 is a schematic sectional view illustrating a basal plate on which electrostatic flocked piles are bonded.
Figure 6:
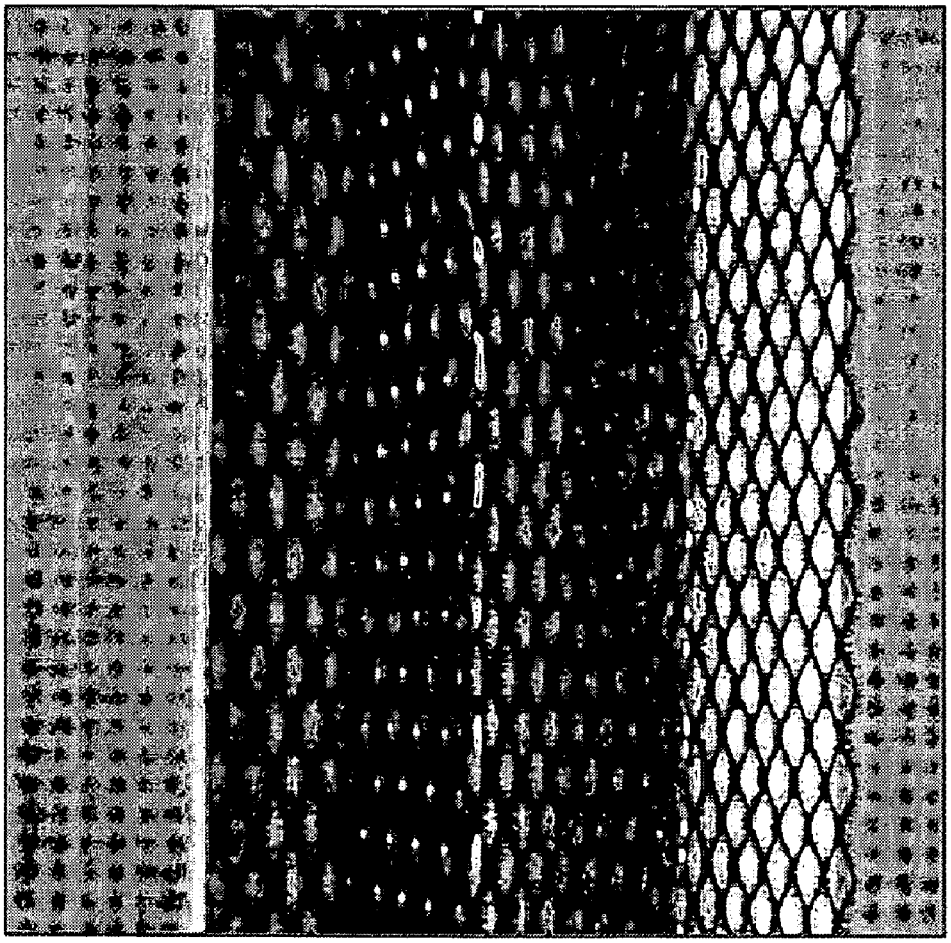
FIG. 6 is a photograph showing a mesh electrode on which electrostatic flocked piles are bonded.

FIG. 5 schematically shows the electrostatic flocked piles 55 secured to the substrate 60 by the adhesive layer 61. Since the electrostatic flocked piles 55 bonded to the substrate are polarized and oriented, the polarized state can be continuously maintained by the application of an electric power. The polarized state of the piles 55 enables them to electrostatically adsorb ionized particles such as dust. FIG. 6 shows the electrostatic flocked piles actually being uniformly disposed on the surface of the mesh electrode.

In an air cleaner according to the present invention, it is important to control the shape of the electrostatic flocked piles because they filter out dust or the like by physical contact, as well by an electrostatic attraction. If the electrostatic flocked piles are thick or long, the physical contact can be increased. Further, discharge current properties may differ according to the length of the electrostatic flocked piles, as shown in Table 1.

TABLE 1

Discharge Current Properties depending on the Length of Electrostatic Flocked Piles

| Applied Voltage (kV) | Discharge Current (μA) | | |
|---|---|---|---|
| | No Electrostatic Flocking Done | 0.4 mm Pile | 0.7 mm Pile |
| 4 | 0 | 0 | 0 |
| 4.5 | 0 | 4 | 9 |
| 4.6 | 4 | 17 | 24 |
| 4.8 | 30 | 50 | 55 |
| 5 | 50 | 90 | 95 |
| 5.5 | 170 | 210 | 220 |
| 6 | 300 | 370 | 380 |

As shown in Table 1, it is clear that discharge currents for the same applied voltage are larger when electrostatic flocked piles are included as compared to when no electrostatic flocking is done. Also, the discharge currents are larger when the electrostatic flocked piles are 0.7 mm in length as compared to when they are 0.4 mm in length. These results indicate that the filtering effect caused by an electrostatic force can be acquired by forming electrostatic flocked piles on components of the air cleaner, and that the longer the electrostatic flocked piles, the larger the filtering effect caused by an electrostatic force.

Figure 7:
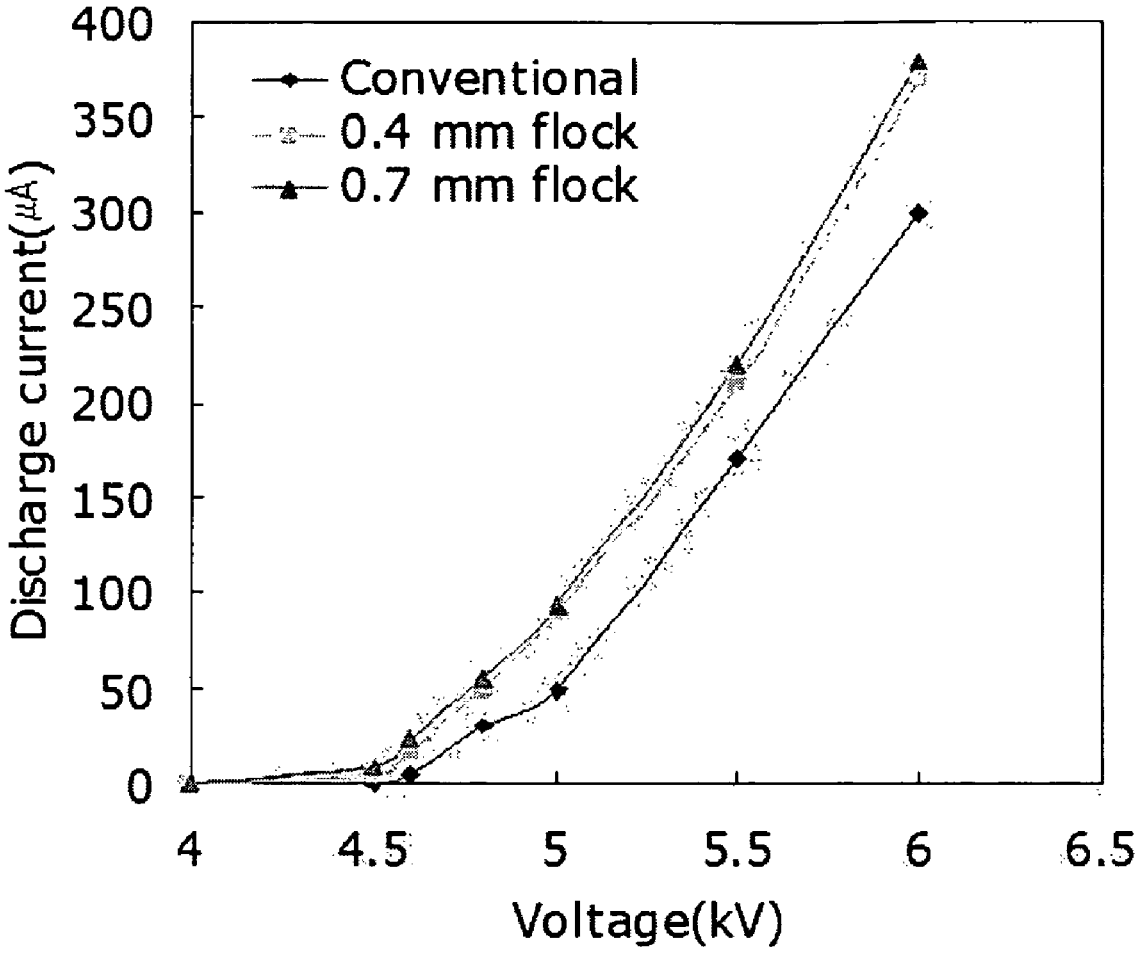
FIG. 7 is a graph illustrating discharge current characteristics depending on the length of electrostatic flocked piles.

The result of Table 1 can also be understood by observing changes in discharge current depending on changes in voltage as shown in FIG. 7.

Figure 8:
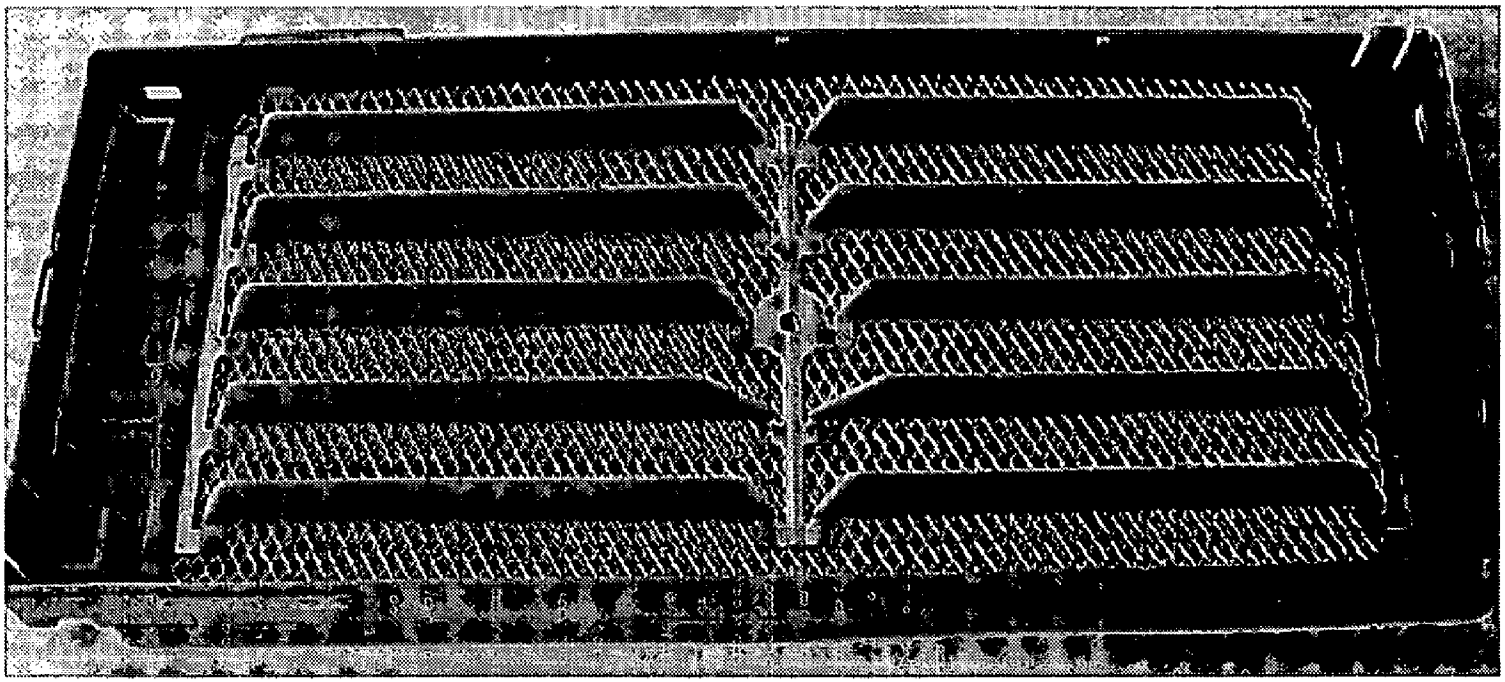
FIG. 8 is a photograph of an air cleaner actually manufactured for illustration.

FIG. 8 is a photograph showing an example of an air cleaner embodying the invention. The air cleaner may be provided in a device that is configured to be attached to an air conditioning apparatus, as well as being an independent product. The technical construction of the air cleaner mounted to an air conditioning apparatus is well known to those skilled in the art, thus a detailed description will be omitted.

The air cleaning performance of an air cleaner embodying the present invention was tested. In the ionization unit, one discharge electrode was formed of a metal wire, and the opposed electrode was made of a metal plate material or a metal plate material whose surface was electrostatically flocked. As the auxiliary filter, an Al mesh electrode or a mesh electrode containing piles electrostatically flocked thereon was used. As the dust collection unit, a metal plate material or a mesh electrode containing electrostatic flocked piles is used. A high voltage was applied to the ionization unit. The auxiliary filter and the dust collection unit were grounded, or at least no voltage was applied. The result of an air cleaning performance test on this filter is as shown in Table 2. It can be seen that if the electrodes contain electrostatic flocked piles, the air cleaning performance is excellent on the whole. The clean air delivery rate can be improved significantly by about 20% compared to an air cleaner of a comparative configuration which does not have the electrostatic flocking.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An electrostatic air cleaner, comprising:

an ionization unit configured to receive particle laden air and to impart an electrical charge to particles contained in the particle laden air; and a collection unit positioned downstream of the ionization unit and configured to receive particle laden air including electrically charged particles from the ionization unit, to remove and collect particles from the received particle laden air, and to discharge substantially particle free air, wherein the collection unit comprises:

at least one flat mesh plate electrode; and a first plurality of flocked piles provided on a side of the at least one mesh plate electrode facing the ionization unit, wherein the first plurality of flocked piles are polarized so as to attract the electrically charged particles in the particle laden air and allow substantially particle free air to pass through the at least one mesh plate electrode.

TABLE 2

| | | Ionization Unit | | | Dust Collection unit | |
|---|---|---|---|---|---|---|
| | Clean air delivery rate (CADR) | Discharge Electrode | Opposed Electrode | Auxiliary Filter | Shape | Application of Electric Field |
| Comparative Example | 43 | Wire | Plate Material | Al Mesh | Plate Material | ○ |
| Example 1 | 50 | Wire | Electrostatic Flocked Plate Material | Al Mesh | Plate Material | ○ |
| Example 2 | 65 | Wire | Plate Material | Electrostatic Flocked Mesh | Plate Material | ○ |
| Example 3 | 21 | Wire | Plate Material | Electrostatic Flocked Mesh | Electrostatic Flocked Mesh | X |
| Example 4 | 60 | Wire | Electrostatic Flocked Plate Material | Al Mesh | Plate Material | ○ |
| Example 5 | 64 | Wire | Electrostatic Flocked Plate Material | Electrostatic Flocked Mesh | Plate Material | ○ |
| Example 6 | 53 | Wire | Plate Material | Al Mesh | Electrostatic Flocked Mesh | ○ |
| Example 7 | 49 | Wire | Plate Material | Electrostatic Flocked Mesh (earthed) | Electrostatic Flocked Mesh | ○ |
| Example 8 | 50 | Wire | Plate Material | Electrostatic Flocked Mesh | Electrostatic Flocked Mesh | ○ |

As described above, an air cleaner according to the present invention can further improve the performance of air cleaners by including electrostatic flocked piles. Moreover, the air cleaning performance can be changed according to size, length, etc. of the electrostatic flocked piles. The air cleaner of the present invention may be mounted to an air conditioning apparatus or the like to auxiliary perform air cleaning operations.

2. The electrostatic air cleaner of claim 1, wherein the ionization unit comprises:

at least one discharge electrode; and at least one opposed electrode spaced apart from the discharge electrode.

3. The electrostatic air cleaner of claim 2, further comprising a second plurality of flocked piles provided on the at least one opposed electrode of the ionization unit.

4. The electrostatic air cleaner of claim 2, wherein the at least one opposed electrode has a plate shape.

5. The electrostatic air cleaner of claim 4, further comprising a second plurality of flocked piles provided on the at least one opposed electrode of the ionization unit.

6. The electrostatic air cleaner of claim 2, wherein the at least one opposed electrode comprises a metal mesh.

7. The electrostatic air cleaner of claim 6, further comprising a second plurality of flocked piles are disposed on the at least one opposed electrode of the ionization unit.

8. The electrostatic air cleaner of claim 1, further comprising a voltage supply configured to apply a voltage to the at least one flat mesh plate electrode of the collection unit so as to polarize the first plurality of flocked piles.

9. The electrostatic air cleaner of claim 8, wherein the power supply also applies a voltage to the ionization unit.

10. The electrostatic air cleaner of claim 9, further comprising a second plurality of flocked piles provided on the ionization unit, wherein the voltage applied to the ionization unit also causes the second plurality of flocked piles provided on the ionization unit to be electrically polarized.

11. The electrostatic air cleaner of claim 1, further comprising an auxiliary filter.

12. The electrostatic air cleaner of claim 11, wherein the auxiliary filter comprises a mesh, and wherein a plurality of flocked piles are disposed on the mesh.

13. An air conditioner comprising the electrostatic air cleaner of claim 1.

14. An electrostatic air cleaner, comprising:

an ionization unit configured to impart an electrical charge to particles contained in a flow of air entering the air cleaner, wherein the ionization unit comprises:

a discharge electrode; and an opposed electrode spaced apart from the discharge electrode; and a collection unit configured to remove and collect particles from the flow of air after it has passed through the ionization unit, wherein the collection unit comprises a plurality of opposed electrodes which form a flat mesh plate electrode, and wherein a first plurality of flocked piles are disposed on the plurality of opposed electrodes of the collection unit.

15. The electrostatic air cleaner of claim 14, wherein a plurality of flocked piles are disposed on the opposed electrode of the ionization unit.

16. The electrostatic air cleaner of claim 14, further comprising an auxiliary filter disposed between the ionization unit and the collection unit, wherein a second plurality of flocked piles is provided on the auxiliary filter.

17. The electrostatic air cleaner of claim 14, further comprising a voltage supply configured to apply a voltage to the plurality of opposed electrodes of the collection unit, wherein the voltage applied to the plurality of opposed electrodes electrically polarizes the first plurality of flocked piles such that the first plurality of flocked piles electrically attract particles in the air flowing through the collection unit.

18. The electrostatic air cleaner of claim 17, further comprising a third plurality of flocked piles provided on the opposed electrode of the ionization unit, wherein the voltage supply also applies a voltage to the ionization unit, and wherein the voltage applied to the ionization unit electrically polarizes the third plurality of flocked piles such that the third plurality of flocked piles electrically attract particles in the air flowing through the ionization unit.

* * * * *